US007506419B2

(12) United States Patent
Kung

(10) Patent No.: US 7,506,419 B2
(45) Date of Patent: Mar. 24, 2009

(54) BUCKLE USING A SLIDE COVER TYPE FEMALE BUCKLE MEMBER

(75) Inventor: Tsung-Min Kung, Taipei (TW)

(73) Assignee: Nifco Taiwan Corporation, Taipei (TW)

( * ) Notice: Subject to any disclaimer, the term of this patent is extended or adjusted under 35 U.S.C. 154(b) by 0 days.

(21) Appl. No.: 11/557,497

(22) Filed: Nov. 8, 2006

(65) Prior Publication Data

US 2007/0107169 A1 May 17, 2007

(30) Foreign Application Priority Data

Nov. 11, 2005 (CN) ..... 2005 2 0105757 U

(51) Int. Cl.
*A44B 11/25* (2006.01)

(52) U.S. Cl. ..... 24/656; 24/303; 24/695

(58) Field of Classification Search ..... 24/303, 24/652–658, 695

See application file for complete search history.

(56) References Cited

U.S. PATENT DOCUMENTS 3,152,376 A * 10/1964 Boser et al. ..... 24/618
3,364,532 A * 1/1968 Hatfield ..... 24/658
6,295,702 B1 * 10/2001 Bauer ..... 24/303
6,330,736 B1 * 12/2001 Cheng ..... 24/656

* cited by examiner

*Primary Examiner*—James R Brittain

(57) ABSTRACT

A buckle includes a male buckle member having a locating bolt, and a slide cover type female buckle member, which has a buckle body, which has an insertion hole for the insertion of the locating bolt of the male buckle member and a notch for the positioning of the locating bolt, a slide cover slidably coupled to the buckle body and movable between a close position where a front notch of the slide cover is forced into engagement with a shank of the locating bolt of the male buckle member to secure the locating bolt firmly to the notch of the buckle body and an open position where the locating bolt is removable from the insertion hole, and two magnetic elements respectively affixed to the buckle body and the slide cover and attractable to each other by magnetic attraction when the slide cover is moved to the close position.

9 Claims, 11 Drawing Sheets

BUCKLE USING A SLIDE COVER TYPE FEMALE BUCKLE MEMBER

BACKGROUND OF THE INVENTION

1. Field of the Invention

The present invention relates to buckles and more particularly, to such a buckle that uses a slide cover type female buckle member 2. Description of the Related Art Conventional buckles that are formed of a male buckle member and a female buckle member are commonly used in backpacks, travel bags, shoulder bags, etc., to join two parts together. FIGS. 8 and 9 show a buckle of this kind. As illustrated, a buckle A is comprised of a male buckle member A1 and a female buckle member A2. The male buckle member A1 has a center guide rod A12 forwardly extending from the front side, and two spring arms A11 forwardly extending from the front side and equally spaced from the center guide rod A12 at two sides. The two spring arms A11 each have a front end terminating in a retaining block A13 that defines a barbed engagement portion A14. The female buckle member A2 has a front open side A21, a longitudinal track A22 disposed on the inside and extending to the front open side A21 on the middle, and two side holes A23 respectively cut through the two opposite lateral sidewalls thereof. The side holes S23 each define a front engagement edge A231. When in use, the center guide rod A12 and two spring arms A11 of the male buckle member A1 are inserted into the front open side A21 of the female buckle member A2 to force the center guide rod A12 into the longitudinal track A22, and at the same time the two spring arms A11 are squeezed in direction toward the center guide rod A12 by the two opposite lateral sidewalls of the female buckle member A2. After insertion of the center guide rod A12 into the longitudinal track A22, and the spring power of the spring arms A11 of the male buckle member A1 forces the retaining blocks A13 sideways, thereby causing engagement of the barbed engagement portions A14 of the retaining blocks A13 with the respective front engagement edges A231.

The aforesaid buckle is functional, however it still has drawbacks as follows:

1. This buckle design is not suitable for use in a small-sized product. When unlocking the buckle A, the user must use the fingers to squeeze the retaining blocks A13 and to further force the respective barbed engagement portions A14 from the respective front engagement edges A231. If the male buckle member A1 and the female buckle member A2 are small-sized, squeezing the retaining blocks A13 of the spring arms A11 with the fingers will be inconvenient or difficult.

2. Because the spring arms A11 and the center guide rod A12 are suspending at the front side of the male buckle member A1, they may be permanently deformed or broken accidentally when the male buckle member A1 is not fastened to the female buckle member A2.

3. The structural design of the buckle A is complicated and the matching precision of the male buckle member A1 and the female buckle member A2 is critical, and therefore the fabrication of the buckle A is complicated, showing a low yield rate.

4. When fastening the male buckle member A1 to the female buckle member A2, the center guide rod A12 must be accurately aimed at the longitudinal track A22 to ensure accurate positioning.

5. The male buckle member A1 and the female buckle member A2 must match each other in specification. Further, the male buckle member A1 can only be fastened to the female buckle member A2 in one particular direction. This design limits the direction of arrangement of the belts being respectively fastened to the male buckle member A1 and the female buckle member A2, and the belts tend to be wrinkled after installation of the buckle A.

Therefore, it is desirable to provide a buckle that eliminates the aforesaid drawbacks.

SUMMARY OF THE INVENTION

The present invention has been accomplished under the circumstances in view. According to one aspect of the present invention, the buckle is comprised of a male buckle member and a slide cover type female buckle member. The male buckle member has a locating bolt connectable to the slide cover type female buckle member. The slide cover type female buckle member comprises a buckle body, a slide cover, and two magnetic elements. The buckle body has an insertion hole disposed near a front side thereof for receiving the locating bolt of the male buckle member, and a notch formed in the insertion hole and fitting a periphery of the locating bolt of the male buckle member. The slide cover is coupled to and movable along the buckle body between a close position and an open position. The slide cover has a front notch formed on a front side thereof, which forms with the notch of the buckle body an axle hole, which receives and secures the locating bolt of the male buckle member after insertion of the locating blot of the male buckle member into the insertion hole and after the slide cover has been moved to the close position The two magnetic elements are respectively affixed to the buckle body and the slide cover and attractable to each other by magnetic attraction when the slide cover is moved to the close position.

According to another aspect of the present invention, the male buckle member can be made having a mounting slot for the fastening of an external belt member. Alternatively, the male buckle member can be made in the form of a stud that can be fastened to a fabric member with stitches.

DETAILED DESCRIPTION OF THE PREFERRED EMBODIMENT

Figure 1:
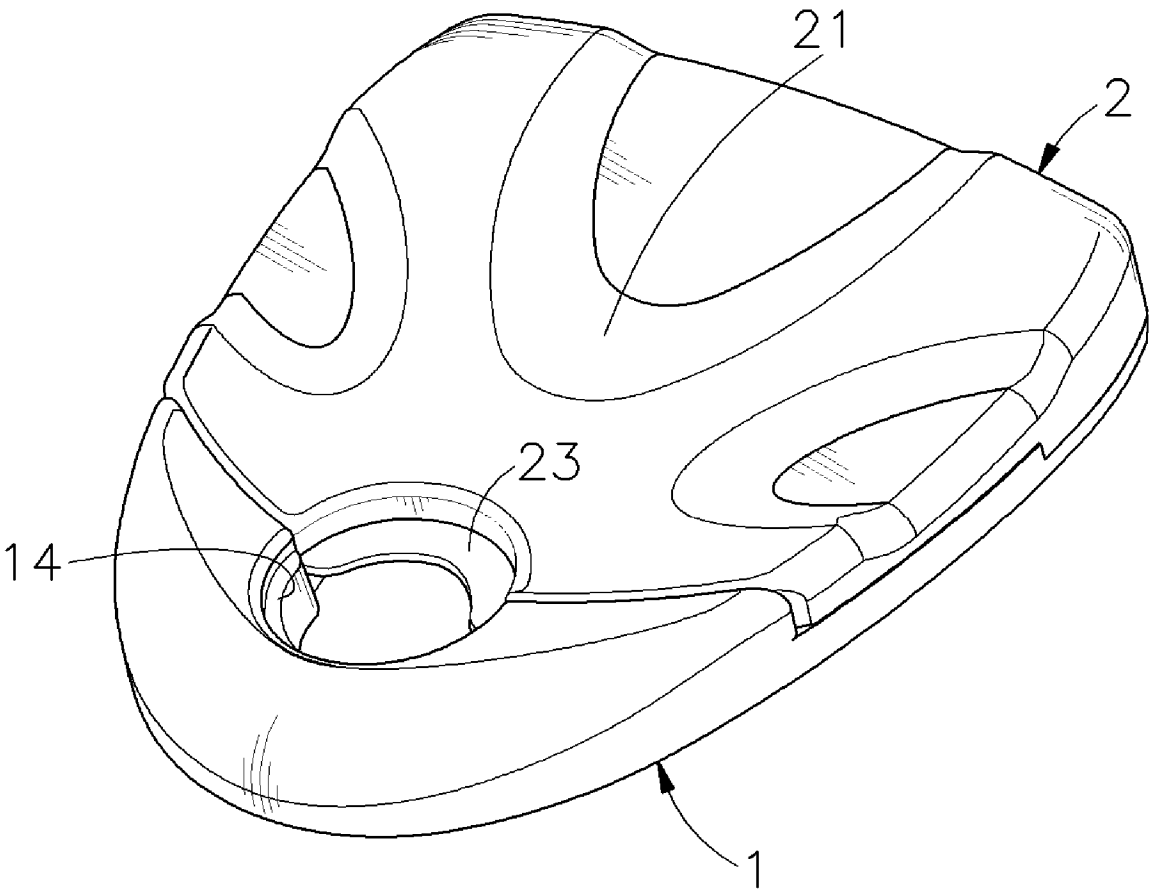
FIG. 1 is an elevational view of a slide cover type female buckle member in accordance with a first embodiment of the present invention.
Figure 2:
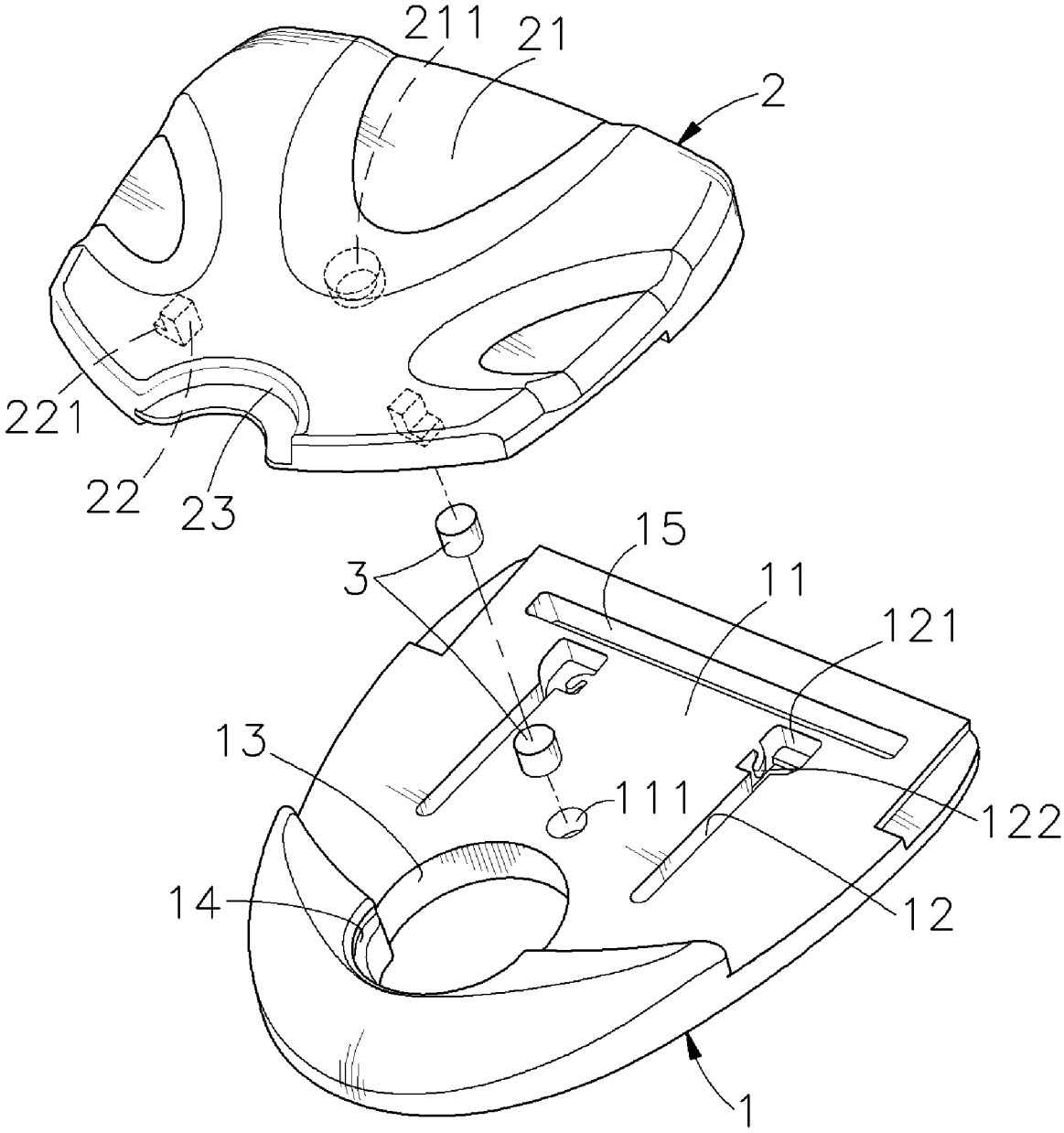
FIG. 2 is an exploded view of the slide cover type female buckle member in accordance with the first embodiment of the present invention.
Figure 3:
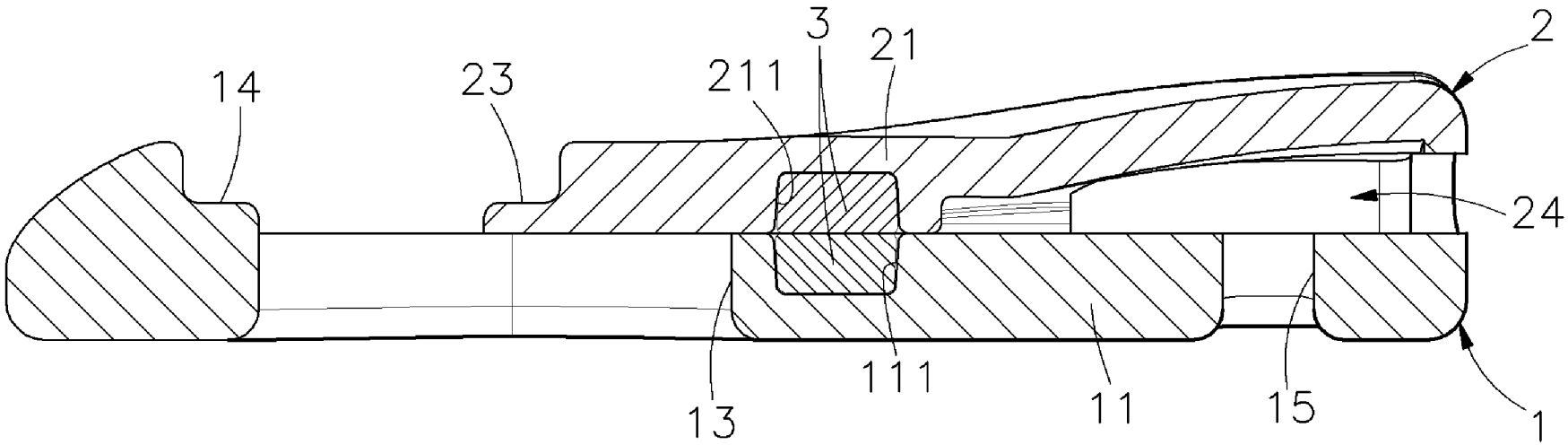
FIG. 3 is a sectional view in an enlarged scale of the slide cover type female buckle member according to the first embodiment of the present invention, showing the slide cover in the close position.

Referring to FIGS. 1~4, a slide cover type female buckle member in accordance with the present invention is shown to be used with a male buckle member 4, i.e., the slide cover type female buckle member and the male buckle member 4 constitute a buckle. The slide cover type female buckle member is comprised of a buckle body 1 and a slide cover 2. The male buckle member 4 has a mounting slot 42 at one side, namely, the rear side, and a locating bolt 41 at the other side, namely, the front side (According to this embodiment, the locating bolt 41 is a headed bolt having a shank perpendicularly upwardly extended from the top wall of the male buckle member 4 and terminating in a head).

The buckle body 1 has a flat base 11. The flat base 11 has a recessed hole 111 on the top surface, two longitudinal sliding slots 12 cut through the top and bottom walls and arranged in parallel at two sides of the recessed hole 111, two receiving holes 121, which extend through the top and bottom walls and are respectively connected to one end, namely, the rear end of each of the longitudinal sliding slots 12 and each have a transverse width relatively greater than the longitudinal sliding slots 12, two stop rods 122 respectively suspending in the receiving holes 121 at one side, an insertion hole 13 cut through the top and bottom walls near the front side, a notch 14 in the insertion hole 13 at one side, and a mounting slot 15 cut through the top and bottom walls near the rear side for the mounting of a belt.

The slide cover 2 comprises a cover shell 21 slidably coupled to the flat base 11 of the buckle body 1. The cover shell 21 has a recessed hole 211 on the bottom wall corresponding to the recessed hole 111, two guide blocks 22 bilaterally protruded from the bottom wall corresponding to the longitudinal sliding slots 12, two guide rods 221 respectively perpendicularly extending from the guide blocks 22 at one side, a front notch 23 on the front side, and a mounting portion 24 on the rear side of the bottom wall for mounting.

Further, two magnetic elements 3 are respectively affixed to the recessed hole 111 of the flat base 11 of the buckle body 1 and the recessed hole 211 of the cover shell 21 of the slide cover 2.

Referring to FIGS. 5 and FIGS. 1~4 again, the two guide rods 221 are inserted with the two guide blocks 22 into the receiving holes 121, and then the cover shell 21 is pushed forwards to force the guide rods 221 over the respective stop rods 122 into the respective longitudinal sliding slots 12, and therefore the cover shell 21 of the slide cover 2 is coupled to the flat base 11 of the buckle body 1 and movable forwards/backwards along the longitudinal sliding slots 12 relative to the flat base 11 of the body 1.

Figure 4:
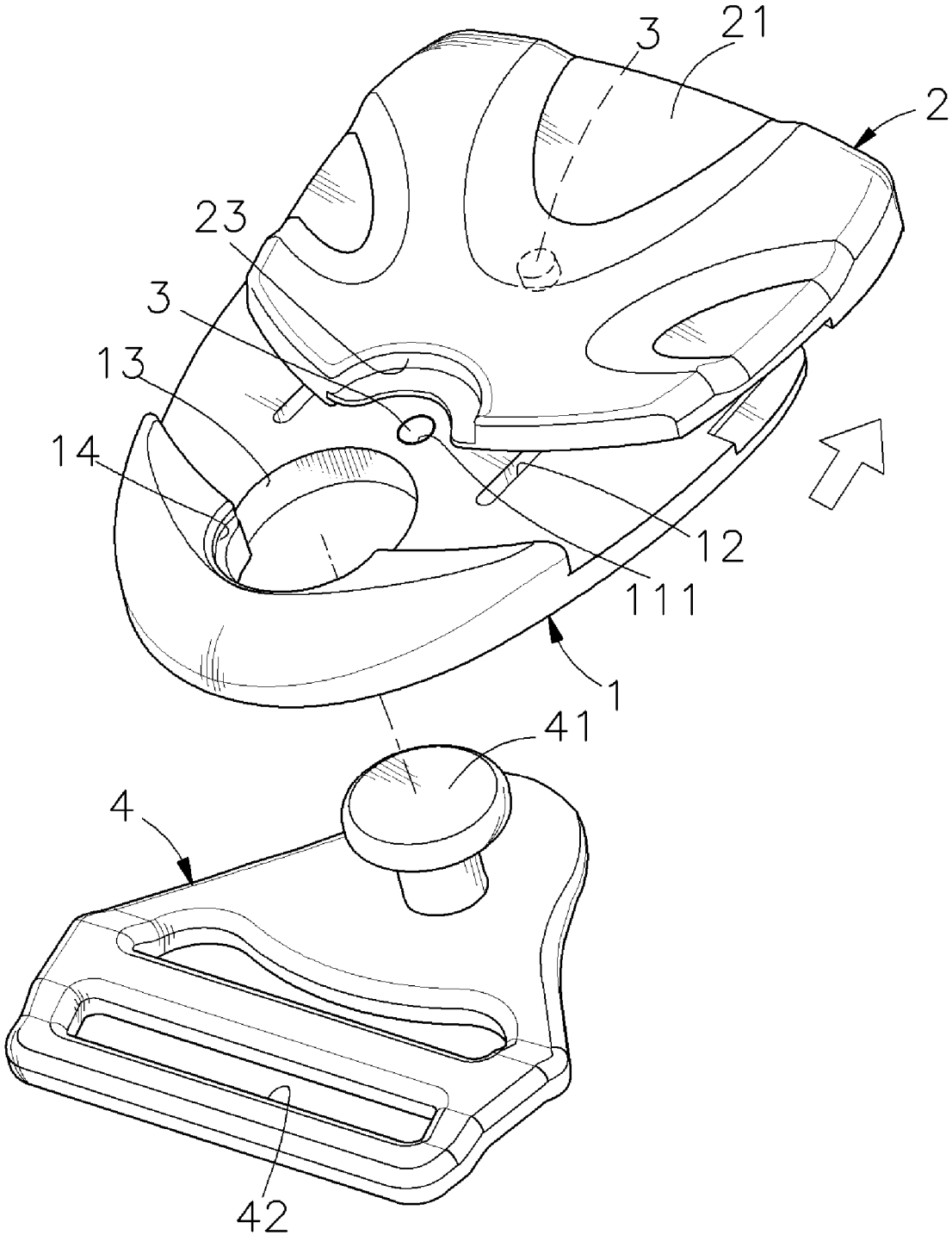
FIG. 4 is a schematic drawing of the buckle according to the first embodiment of the present invention before connection of the male buckle member to the slide cover type female buckle member, showing the slide cover moved to the open position.
Figure 4A:
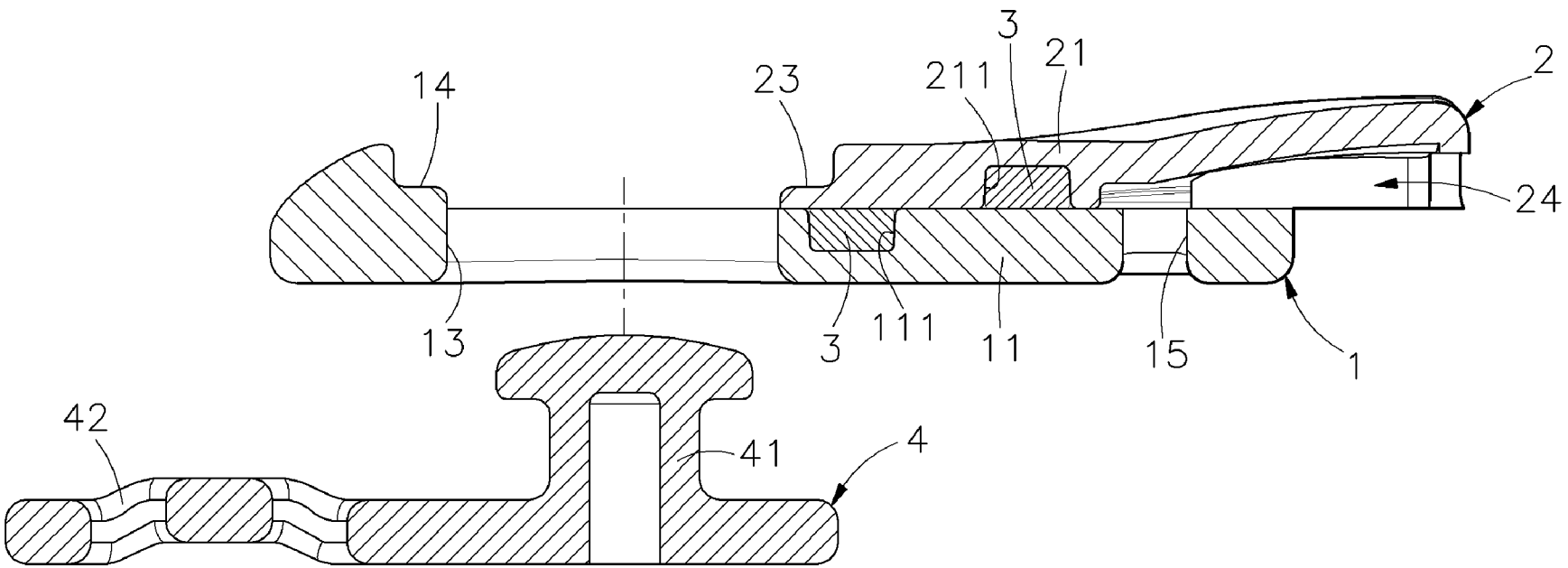
FIG. 4A is a sectional side view in an enlarged scale of FIG. 4.
Figure 5:
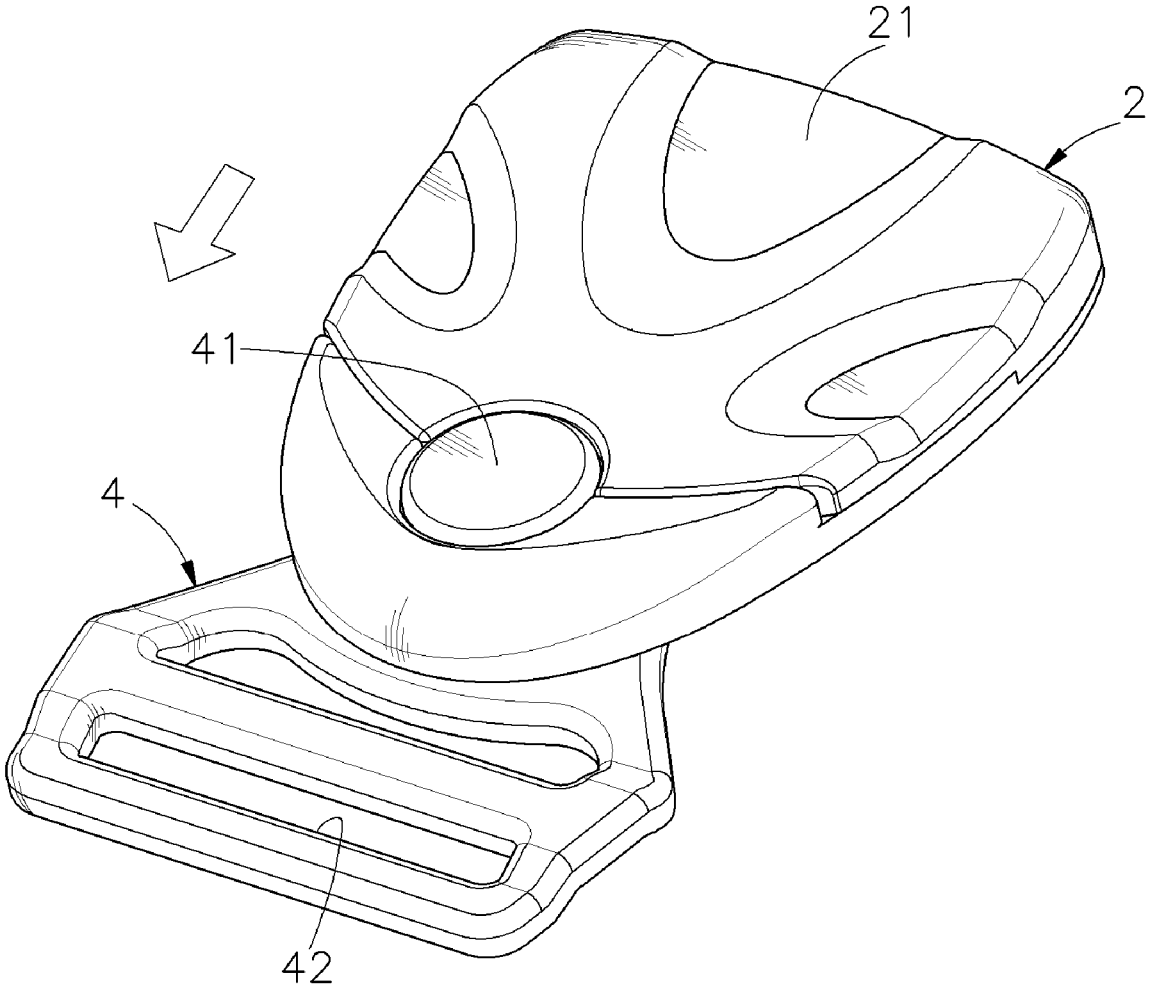
FIG. 5 is a schematic drawing of the buckle according to the first embodiment of the present invention, showing the locating bolt of the male buckle member fastened to the slide cover type female buckle member and the slide cover moved to the close position.
Figure 5A:
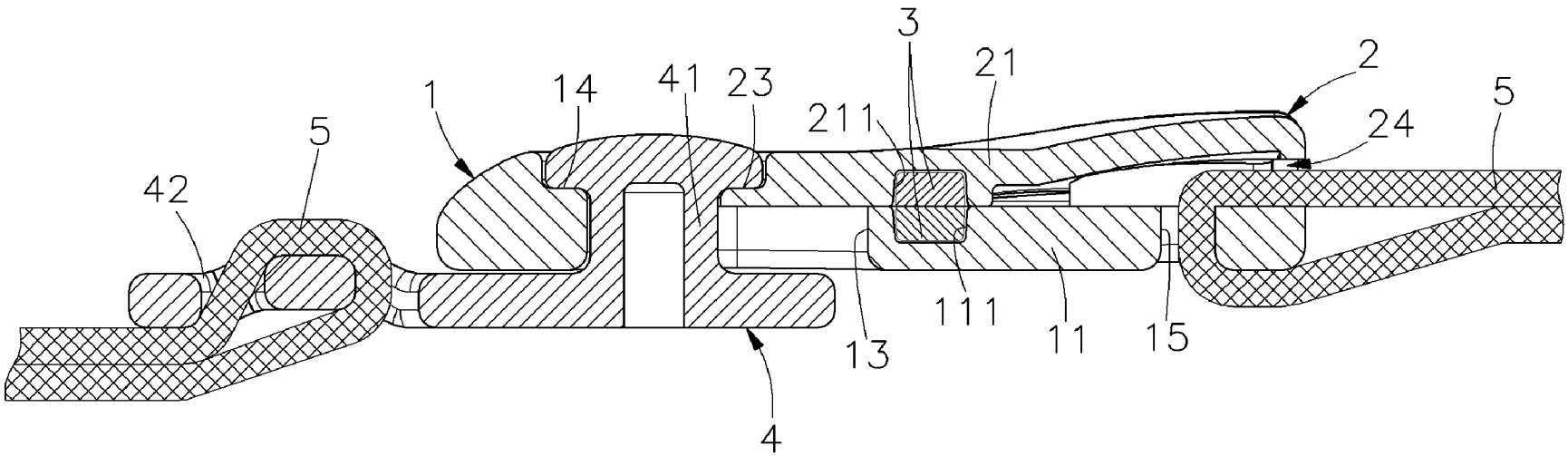
FIG. 5A is a sectional side view in an enlarged scale of FIG. 5.

When in use, one belt members 5 is inserted through the mounting slot 15 of the flat base 11 of the buckle body 1 and fastened to the mounting portion 24 of the cover shell 21 of the slide cover 2, and the other belt members 5 is fastened to the mounting slot 42 of the male buckle member 4. Thereafter, the slide cover 2 is moved backwards relative to the buckle body 1 from the close position (see FIGS. 1 and 3) to the open position to disengage the magnetic elements 3 (see FIGS. 4 and 4A). At this time, the insertion hole 13 is fully opened, and the two guide blocks 22 are respectively stopped at the stop rods 122. Thereafter, the locating bolt 41 of the male buckle member 4 is inserted into the insertion hole 13 of the buckle body 1, and then the slide cover 2 is moved forwards relative to the buckle body 1 from the open position (see FIGS. 4 and 4A) to the close position (see FIGS. 5 and 5A). At this time, the two magnetic elements 3 are aligned and attracted by magnetic attraction, and the front notch 23 is forced into engagement with the periphery of the shank of the locating bolt 41, i.e., the front notch 23 of the slide cover 2 and the notch 14 of the buckle body 1 form an axle hole corresponding to the diameter of the shank of the locating bolt 41, thereby locking the locating bolt 41 to the buckle body 1. By means of the aforesaid arrangement, the belt member 5 that is fastened to the male buckle member 4 can be rotated with the male buckle member 4 in the insertion hole 13 relative to the buckle body 1 to any desired direction after closing the slide cover 2.

Figure 6:
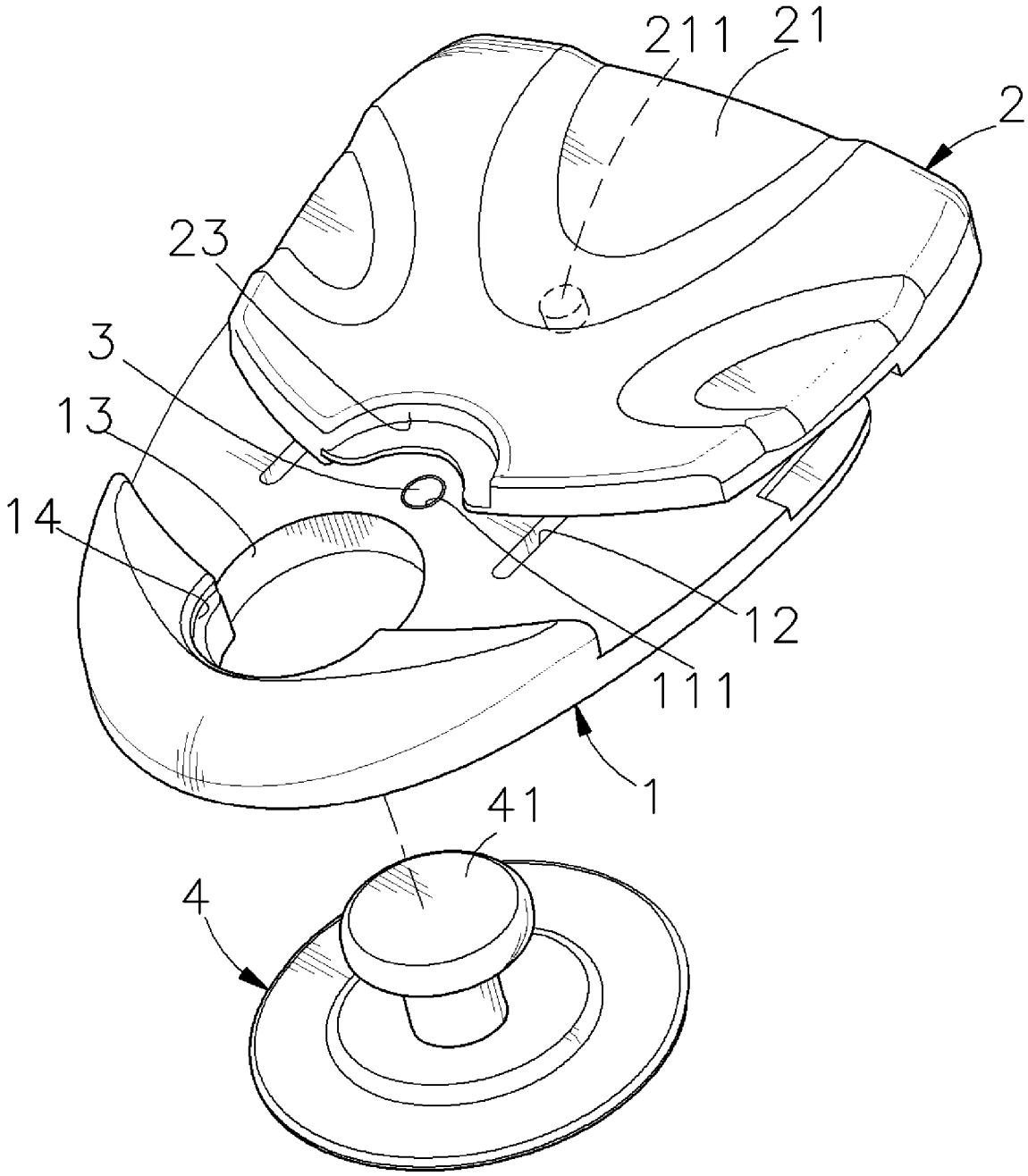
FIG. 6 is an exploded elevational view of a buckle in accordance with a second embodiment of the present invention.
Figure 7:
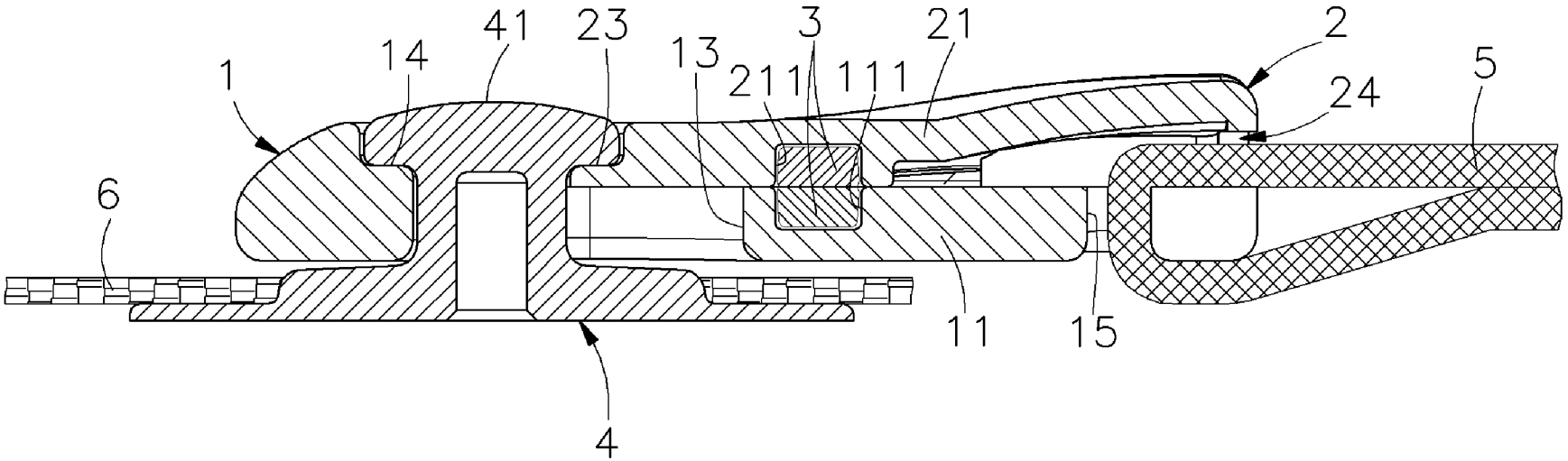
FIG. 7 is a sectional view of the second embodiment of the present invention, showing the buckle installed.
Figure 8:
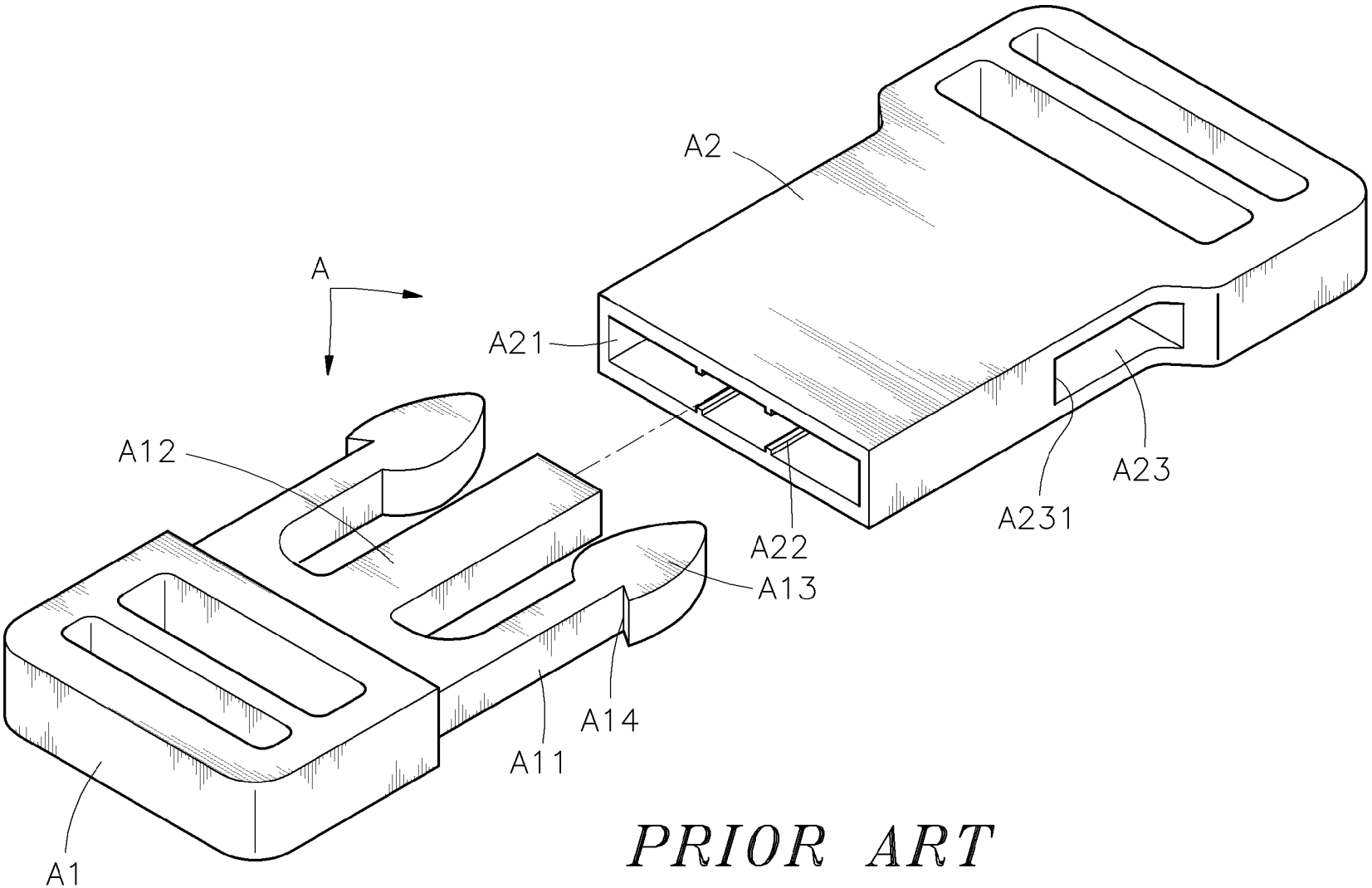
PRIOR ART FIG.8
FIG. 8 is an exploded view of a buckle according to the prior art.
Figure 9:
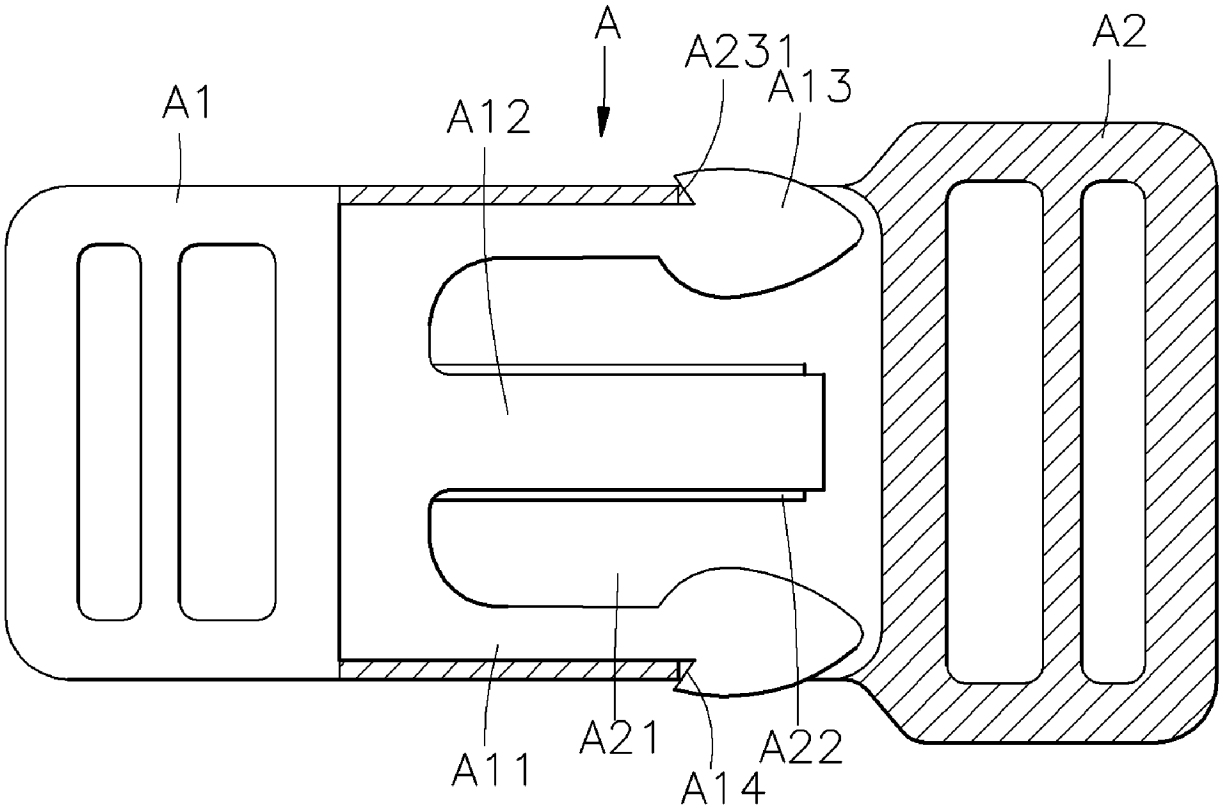
PRIOR ART FIG. 9
FIG. 9 is a sectional view of the buckle according to the prior art design, showing the male buckle member and the female buckle member locked.

FIGS. 6 and 7 show a buckle in accordance with a second embodiment of the present invention. According to this embodiment, the slide cover type female buckle member is same as the aforesaid first embodiment. The male buckle member 4 according to this second embodiment is a stud fixedly fastened to the inside wall of a fabric member 6 with stitches, having a locating bolt 41 extended out of the fabric member 6 for fastening to the insertion hole 13 of the buckle body 1 of the slide cover type female buckle member after the slide cover 2 has been moved to the open position. After insertion of the locating bolt 41 of the male buckle member 4 into the insertion hole 13 of the buckle body 1 of the slide cover type female buckle member, the slide cover 2 is moved from the open position to the close position to force the front notch 23 of the slide cover 2 into engagement with the periphery of the shank of the locating bolt 41, thereby locking the locating bolt 41 to the buckle body 1.

As indicated above, the invention provides a buckle formed of a slide cover type female buckle member and a male buckle member. The buckle of the present invention has the following features:

1. The slide cover 2 of the slide cover type female buckle member is slidably coupled to the buckle body 1, and therefore the size of the female buckle member is greatly reduced. Further, locking/unlocking of the buckle can easily be operated by means of moving the slide cover 2 relative to the buckle body 1 between the close position and the open position.

2. When the slide cover 2 is closed on the buckle body 1, the connection mechanism between the male buckle member and the female buckle member is kept from sight and well protected by the slide cover 2.

3. The slide cover 2 and the buckle body 1 are simple in structure and easy to install. When locked, the male buckle member 4 does not escape from the slide cover type female buckle member. The matching precision between the buckle body 1 and the slide cover 2 is not critical, and therefore the yield rate of the fabrication of the present invention is high.

4. When locking or unlocking the buckle, the user needs only to move the slide cover 2 relative to the buckle body 1 between the close position and the open position. When the slide cover 2 is moved to the close position, the front notch 23 is forced into positive engagement with the shank of the locating bolt 41 of the male buckle member 4, thereby securing the male buckle member 4 to the slide cover type female buckle member positively. The present invention eliminates the alignment procedure of the prior art design.

5. After coupling of the male buckle member 4 to the slide cover type female buckle member, the male buckle member 4 can be rotated through 360° relative to the slide cover type female buckle member, preventing wrinkling or tangling of the belts.

6. The two magnetic elements 3 are respectively installed in the slide cover 2 and the buckle body 1 and are used for securing the slide cover 2 to the buckle body 1 in the close position by means of magnetic attraction.

A prototype of buckle has been constructed with the features of FIGS. 1~7. The buckle functions smoothly to provide all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A buckle comprising a slide cover female buckle member and a male buckle member connectable to said slide cover female buckle member, said male buckle member having a connection part connectable to said slide cover female buckle member, wherein said slide cover female buckle member comprises:

a buckle body, said buckle body having an insertion hole disposed near a front side thereof for receiving said connection part of said male buckle member, a notch formed in said insertion hole and fitting a periphery of said connection part of said male buckle member;

a slide cover coupled to and movable along said buckle body between a close position and an open position, said slide cover having a front notch formed on a front side thereof, which forms with said notch of said buckle body an axle hole, which receives and secures said connection part of said male buckle member after insertion of said connection part of said male buckle member into said insertion hole and after said slide cover has been moved to said close position, wherein said slide cover has a recessed hole on a bottom wall thereof; said buckle body has a recessed hole on a top wall thereof; and two magnetic elements respectively fixedly fastened to said recessed hole of said buckle body and said recessed hole of said slide cover and attractable to each other by magnetic attraction when said slide cover is moved to said close position.

2. The buckle as claimed in claim 1, wherein said buckle body of said slide cover female buckle member has at least one longitudinal sliding slot; and said slide cover has at least one guide block respectively coupled to and movable along said at least one longitudinal sliding slot of said buckle body.

3. The buckle as claimed in claim 2, wherein said buckle body of said slide cover female buckle member further has at least one receiving hole respectively disposed in communication with one end of each of said at least one longitudinal sliding slot and at least one stop rod respectively suspending in said at least one receiving hole at one side, said at least one receiving hole having a size greater than said at least one guide block and a transversely width greater than said at least one longitudinal sliding slot.

4. The buckle as claimed in claim 2, wherein said at least one guide block each has a guide rod respectively perpendicularly from one side thereof for stopping at a bottom wall of said longitudinal sliding slot after insertion of said at least one guide block into said at least one receiving hole and moved over said at least one stop rod into said at least one longitudinal sliding slot.

5. The buckle as claimed in claim 1, wherein said buckle body has a mounting slot disposed near a rear side thereof for fastening of an external belt member.

6. The buckle as claimed in claim 1, wherein said slide cover has a mounting portion near a rear side thereof for fastening of an external belt member.

7. The buckle as claimed in claim 1, wherein said connection part of said male buckle member is a locating bolt perpendicularly extended from a top wall thereof.

8. The buckle as claimed in claim 7, wherein said male buckle member is a stud fixedly fastened to an external fabric member with stitches.

9. The buckle as claimed in claim 7, wherein said male buckle member has a mounting slot disposed at one end thereof for the fastening of an external belt member.

* * * * *